US006127687A

United States Patent [19]

Williams et al.

[11] Patent Number: 6,127,687

[45] **Date of Patent: *Oct. 3, 2000**

[54] ARTICLE IRRADIATION SYSTEM HAVING INTERMEDIATE WALL OF RADIATION SHIELDING MATERIAL WITHIN LOOP OF CONVEYOR SYSTEM THAT TRANSPORTS THE ARTICLES

[76] Inventors: Colin Brian Williams, 6559 Avenida Manana, La Jolla, Calif. 92037; John Thomas Allen, 4626 Black Pine Pl., San Diego, Calif. 92130; George Michael Sullivan, Jr., 8778 Elford Ct., San Diego, Calif. 92129

[ * ] Notice: This patent issued on a continued prosecution application filed under 37 CFR 1.53(d), and is subject to the twenty year patent term provisions of 35 U.S.C. 154(a)(2).

[21] Appl. No.: 09/102,942

[22] Filed: Jun. 23, 1998

[51] Int. Cl.[7] ..... G21F 3/04

[52] U.S. Cl. ..... 250/492.3; 250/517.1; 250/455.11

[58] Field of Search ..... 250/492.3, 453.11, 250/454.11, 455.11, 517.1

[56] References Cited

U.S. PATENT DOCUMENTS

| | | | |
|---|---|---|---|
| 3,452,195 | 6/1969 | Brunner | 250/52 |
| 3,564,241 | 2/1971 | Ludwig | 250/52 |
| 4,345,545 | 8/1982 | Miller | 118/621 |
| 4,446,374 | 5/1984 | Ivanov et al. | 250/492.3 |
| 4,852,138 | 7/1989 | Bergere | 378/69 |
| 5,162,096 | 11/1992 | Gozani | 376/159 |
| 5,396,071 | 3/1995 | Atwell et al. | 250/358.1 |
| 5,396,074 | 3/1995 | Peck et al. | 250/453.11 |
| 5,400,382 | 3/1995 | Welt et al. | 378/69 |

*Primary Examiner*—Jack Berman
*Attorney, Agent, or Firm*—Fulwider Patton, et al; Ellsworth R. Roston

[57] ABSTRACT

An article irradiation system includes a radiation source for scanning a target region with radiation; a conveyor system including a process conveyor positioned for transporting articles in a given direction through the target region; radiation shielding material defining a chamber containing the radiation source, the target region and a portion of the conveyor system; wherein the radiation source is disposed along an approximately horizontal axis inside a loop defined by a portion of the conveyor system and is adapted for scanning the articles being transported through the target region with radiation scanned in a plane transverse to the given direction of transport by the process conveyor; and an intermediate wall of radiation shielding material positioned within the loop and transverse to the approximately horizontal axis. The intermediate wall supports a ceiling of the chamber, inhibits photons emitted from a beam stop disposed in a given wall from impinging upon at least one other wall of the chamber and restricts flow throughout the chamber of ozone derived in the target region from the radiation source.

9 Claims, 2 Drawing Sheets

ARTICLE IRRADIATION SYSTEM HAVING INTERMEDIATE WALL OF RADIATION SHIELDING MATERIAL WITHIN LOOP OF CONVEYOR SYSTEM THAT TRANSPORTS THE ARTICLES

BACKGROUND OF THE INVENTION

The present invention generally pertains to irradiation systems that utilize a conveyor system for transporting articles through a target region scanned by radiation from a radiation source and is particularly directed to an improvement in positioning the radiation shielding material of the system.

A prior art irradiation system that utilizes a conveyor system for transporting articles through a target region is described in U.S. Pat. No. 5,396,074 to Peck et al. In such prior art system, the radiation source and a portion of the conveyor system are disposed in a chamber defined by concrete walls, wherein such concrete walls and additional concrete walls defining an angled passageway into the chamber for the conveyor system shield loading and unloading areas located outside of the chamber from radiation derived from the radiation source.

SUMMARY OF THE INVENTION

The present invention provides an article irradiation system, comprising a radiation source positioned for scanning a target region with radiation; a conveyor system including a process conveyor positioned for transporting articles in a given direction through the target region; radiation shielding material defining a chamber containing the radiation source, the target region and a portion of the conveyor system; wherein the radiation source is disposed along an approximately horizontal axis inside a loop defined by a portion of the conveyor system and is adapted for scanning the articles being transported through the target region with radiation scanned in a plane transverse to the given direction of transport by the process conveyor; and an intermediate wall of radiation shielding material positioned within the loop and transverse to said approximately horizontal axis.

The intermediate wall supports a ceiling of the chamber, inhibits photons emitted from a beam stop disposed in a given wall of the chamber from impinging upon at least one other wall of the chamber and restricts flow throughout the chamber of ozone derived in the target region from the radiation source.

Additional features of the present invention are described with reference to the detailed description of the preferred embodiments.

DETAILED DESCRIPTION

Figure 1:
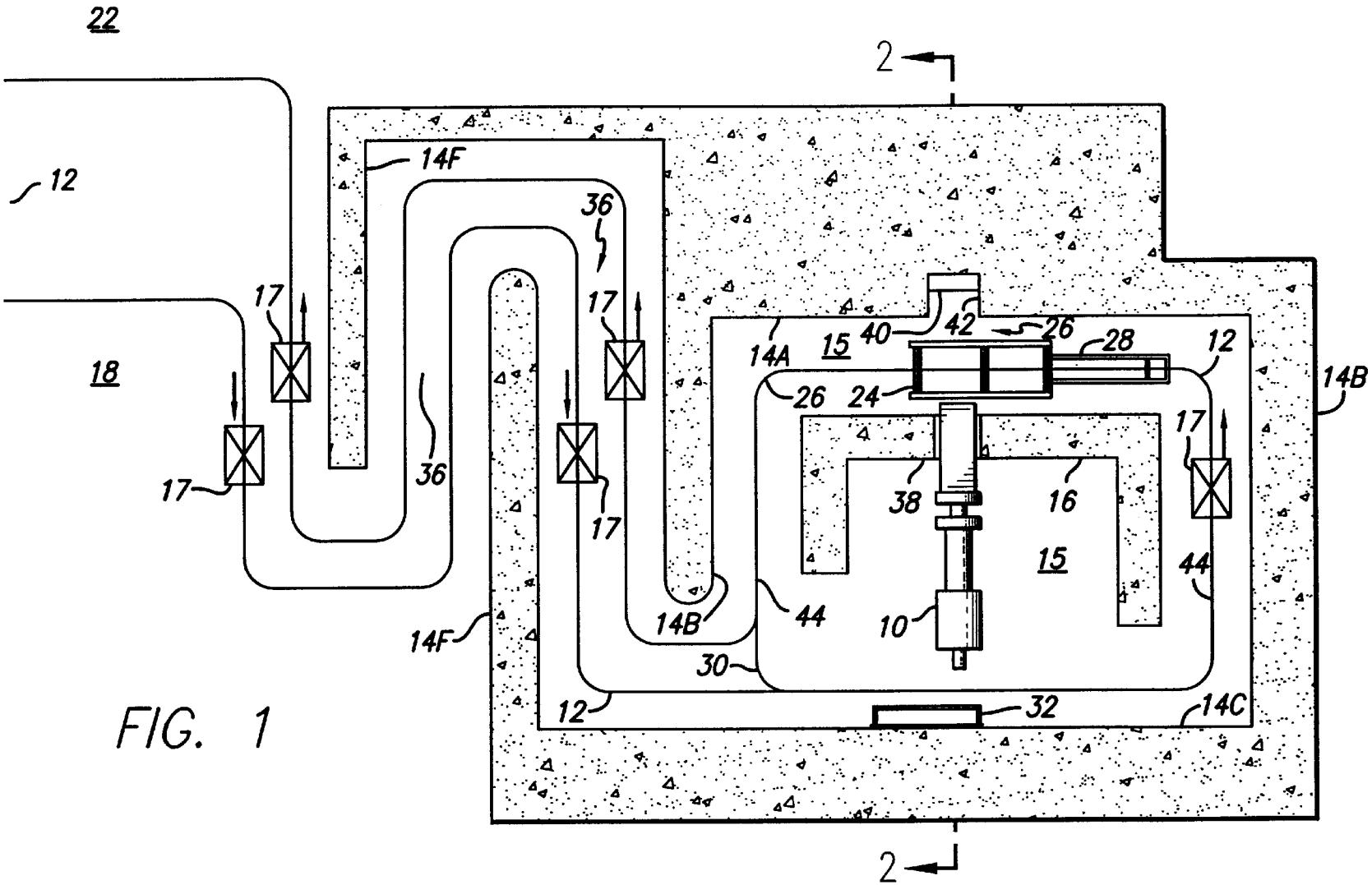
FIG. 1 is a schematic top plan view of a preferred embodiment of an irradiation system according to the present invention.
Figure 2:
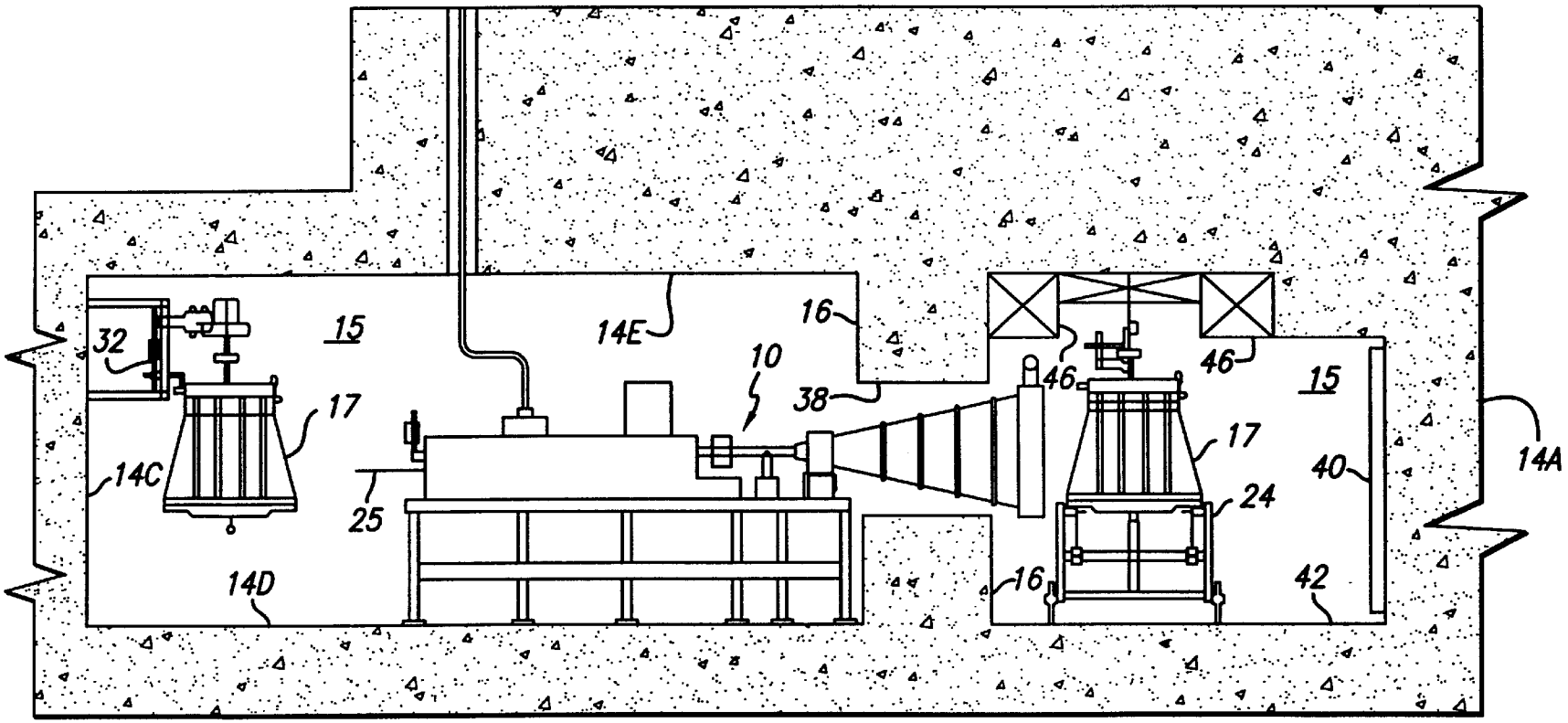
FIG. 2 is a schematic sectional view of a portion of the irradiation system of FIG. 1 as taken along line 2—2 and further showing article carriers in positions other than as shown in FIG. 1.

Referring to FIGS. 1 and 2, a preferred embodiment of an irradiation system according to the present invention includes a radiation source 10, a conveyor system 12, radiation shielding material 14 defining a chamber 15 and an intermediate wall 16 of radiation shielding material. Articles carried by article carriers 17 are transported by the conveyor system 12 in a direction indicated by the arrows from a loading area 18 through a target region generally indicated at 20, to an unloading area 22. The conveyor system 12 includes a process conveyor 24 for transporting articles carried by the article carriers 17 in a given direction through the target region 20.

The radiation source 10 preferably is a 10-million-electron-volt linear accelerator having an electron accelerating wave guide that provides an electron beam for irradiating articles transported through the target region 20 by the conveyor system 12 The radiation source 10 is disposed along an approximately horizontal axis 25 inside a loop 26 defined by a portion of the conveyor system 12 and is adapted for scanning the articles being transported through the target region 20 with an electron beam at a given rate in a plane perpendicular to the given direction of transport by the conveyor system 12. The scanning height and the current of the electron beam are adjusted in accordance with the height and radiation absorption characteristics of the articles being scanned. The scanning of the articles by the electron beam is further controlled as described in the above-referenced U.S. Pat. No. 5,396,074. The accelerator is located inside a removable shield and protected from ionizing radiation and ozone by interior walls. In alternative embodiments, the radiation source scans the articles with a type of radiation other than an electron beam, such as X-rays.

The conveyor system 12 includes a power-and-free conveyor throughout and, in addition to the process conveyor 24, further includes a load conveyor 28, all three of which are independently powered. The power-and-free conveyor functions as a transport conveyor for transporting the article carriers 17 at a first given speed from the process conveyor 24 through the unloading area 22 and the loading area 18 to the load conveyor 28. The process conveyor 24 transports the articles carriers 17 through the target region 20 at a second given speed that is different than the first given speed at which the article carriers 17 are transported by the transport conveyor. The load conveyor 28 transports the article carriers 17 from the transport conveyor to the process conveyor 24 at a speed that is varied during such transport in such a manner that when the article carriers 17 are positioned on the process conveyor 24 there is a predetermined separation distance between adjacent positioned article carriers 17. When an article carrier 17 is positioned on the process conveyor 24, the load conveyor 28 is transporting the article carriers 17 at the speed of the processor conveyor 24. Such a conveyor system 12 and the operation thereof is described in detail in the above-referenced U.S. Pat. No. 5,396,074.

In order to reorient articles for retransportation through the target region 20 so that such articles can be irradiated from opposite sides, upon it being detected that an article carrier 17 carrying such articles is so oriented as to have been transported through the target region 20 only once, such article carrier 17 is diverted onto a reroute conveyor section 30 and then transported by the transport conveyor past a mechanism 32 that reorients the so-oriented article carrier 17 by 180 degrees for said retransportation through the target region 20. Such a reorienting mechanism 32 and means for detecting the orientation of an article carrier 17 are also described in U.S. Pat. No. 5,396,074 to Peck et al.

The radiation shielding material 14 includes walls 14A, 14B, 14C, a floor 14D and a ceiling 14E defining the chamber 15 that contains the radiation source 10, the target region 20 and at least the portion of the conveyor system 12 that includes the process conveyor 24, the load conveyor 28 and the adjacent portions of the transport conveyor. Additional walls 14F of radiation shielding material define an angled passageway 36 into the chamber 15 for the conveyor system 12 and shield the loading area 18 and the unloading area 22, which are located outside of the chamber 15, from radiation derived from the radiation source 10.

The intermediate wall 16 is positioned within the loop 26 and transverse to the approximately horizontal axis 25 of the radiation source 10. The intermediate wall 16 has an aperture 38 through which the radiation source 10 is disposed.

The ceiling section 14E of the radiation shielding material is supported in part by the intermediate wall 16; whereby the underlying chamber 15 may be of a greater area and/or the ceiling section 14E may of a greater span and/or of a greater weight than would be permitted in the absence of such support.

Preferably, the radiation shielding material 14A, 14B, 14C, 14D, 14E, 14F (collectively referred to as 14), 16 is primarily concrete because of cost considerations. However, other types of radiation shielding material may be used when space is limited or in view of other requirements, such as steel. In alternative embodiments, some of the radiation shielding material may be concrete and some not. For example, in one alternative embodiment, the intermediate wall 16 is a type of radiation shielding material other than concrete, such as steel, selected in accordance with limited space requirements, while the remainder of the radiation shielding material 14 is concrete.

A beam stop 40 is disposed in a recess 42 in the wall 14A of radiation shielding material that is on the opposite side of the target region 20 from the electron beam radiation source 10. The beam stop 40 is made of a material, such as aluminum, that absorbs electrons and converts the energy of the absorbed electrons into photons that are emitted from the beam stop 40. The beam stop 40 is so disposed in the recess 42 that some of the photons emitted from the beam stop 40 toward the radiation source 10 but obliquely thereto are inhibited from entering the chamber 15 by the portion of the radiation shielding material in the wall 14A that defines the recess 42. The recessing of the beam stop 40 reduces the intensity of back scattered photons, thereby decreasing the thickness required for the side walls 14B, the back wall 14C and the ceiling section 14E. This reduces construction costs and shortens the construction schedule.

Sections 44 of the transport conveyor portion of the conveyor system 12 are positioned for transporting the article carriers 17 in directions that are transverse to the given direction of transport by the process conveyor 24. The lateral walls 14B of the chamber-defining radiation shielding material are disposed outside the loop 26 adjacent the transversely positioned sections 44 of the conveyor system 12 and portions of the intermediate wall 16 are positioned adjacent these transversely positioned sections 44 of the conveyor system 12 and across from substantial portions of the lateral walls 14A.

The intermediate wall 16 is thereby positioned between the beam stop 40 and the lateral walls 14B so that photons emitted into the chamber 15 from the beam stop 40 are inhibited from impinging upon the lateral walls 14B. The intermediate wall 16 is also positioned between the beam stop 40 and the wall 14C on the opposite side of the chamber 15 from the wall 14A in which the beam stop 40 is recessed so that photons emitted into the chamber 15 from the beam stop 40 are inhibited from impinging upon the opposite wall 14C. As a result, the lateral walls 14B and the opposite wall 14C may be of a lesser thickness of radiation shielding material than would be required in the absence of the intermediate wall 16.

The intermediate wall 16 also is positioned for restricting flow throughout the chamber 15 of ozone derived in the target region 20 from the radiation source 10. Accordingly, most of such ozone can be removed from the chamber 15 by exhaust ducts 46 in the chamber 15 disposed above the target region 20.

The dimensions of the various components of the radiation shielding material 14 and of the intermediate wall of radiation shielding material 16 are determined by computer-aided modeling in accordance a technique described in a manual entitled "MCNP—A General Monte Carlo Code for Neutron and Photon Transport" published by the Radiation Shielding Information Center, P.O. Box 2008, Oak Ridge, Tenn. 37831.

In an alternative embodiment, the loop within which the intermediate wall 14B is positioned is not a closed loop, such as shown in FIG. 1, but instead is an open loop, such as would be formed by elimination of the reroute conveyor section 30.

An article irradiation system in accordance with the present invention provides the advantages of: (a) reducing the volume of concrete required in the ceiling section 14E, thereby reducing the cost and complexity of the structure; (b) reducing radiation levels incident on sensitive electrical and mechanical equipment, such as the radiation Source 10 and the reorienting mechanism 32, thereby prolonging the life of such equipment; and (c) constraining ozone production to the vicinity of the process conveyor 24, thereby reducing the quantity of ozone produced and its dispersal throughout the chamber 15 so as to prolong the life of the equipment and reduce the environmental impact of ozone vented to the atmosphere.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

What is claimed is:

1. An article irradiation system, comprising a radiation source positioned for scanning a target region with radiation, a conveyor system including a process conveyor positioned for transporting articles in a given direction through the target region, radiation shielding material defining a chamber containing the radiation source, the target region and a portion of the conveyor system, wherein the radiation source is disposed along an approximately horizontal axis inside a loop defined by a portion of the conveyor system and is adapted for scanning the articles being transported through the target region with radiation scanned in a plane transverse to the given direction of transport by the process conveyor, and an intermediate wall of radiation shielding material positioned within the loop and transverse to said approximately horizontal axis, a beam stop of material for absorbing electrons and for converting the energy of the absorbed electrons into photons that are emitted from the beam stop, wherein the beam stop is disposed on the opposite side of the target region from the radiation source, wherein the beam stop is recessed within a portion of the chamber-defining radiation shielding material that is disposed on the opposite side of the target region from the radiation source so that some of the photons emitted from the beam stop toward the radiation source but obliquely thereto are inhibited from entering the chamber by said portion of the shielding material.

2. A system according to claim 1, wherein a second portion of the conveyor system is positioned for transporting articles in a second direction that is transverse to the given direction of transport by the process conveyor;

wherein the chamber-defining radiation shielding material includes a lateral wall that is disposed outside the loop adjacent the second portion of the conveyor system; and wherein the intermediate wall is positioned between the beam stop and the lateral wall so that photons emitted into the chamber from the beam stop are inhibited from impinging upon the lateral wall.

3. An irradiation system for irradiating articles, including, a chamber defined by walls, a radiation source constructed to provide radiation in the chamber, a conveyor system constructed to carry the articles through the chamber for the reception by the articles of radiation in the chamber, a beam stop disposed in the chamber for absorbing electrons from the radiation source and for converting energy from the absorbed electrons into photons and for emitting the photons, and the beam stop being disposed relative to a particular one of the walls of the chamber to provide for the reduction in the intensity of the photons in the chamber by the particular one of the walls, and means disposed in the chamber for inhibiting the photons from impinging on the walls defining the chamber, thereby providing for a reduction in the thickness of the walls defining the chamber, the beam stop being recessed in the particular one of the walls of the chamber to provide for the redirection of the intensity of the photons in the chamber by the particular one of the walls, the inhibiting means including an additional wall disposed intermediate the walls defining the chamber and separated from the walls defining the chamber for inhibiting the photons from impinging on the walls defining the chamber, thereby providing for the reduction in the thickness of the walls defining the chamber.

4. An irradiation system as set forth in claim 3 wherein the walls defining the chamber and the additional wall are made from a radiation shielding material.

5. An irradiation system as set forth in claim 4 wherein a ceiling is provided and is made from a radiation shielding material and wherein the additional wall supports the ceiling.

6. A method of providing an irradiation of articles, including the steps of:

providing a chamber defined by a plurality of walls, providing a loading area for the articles at a position displaced from the chamber, providing an unloading area for the articles at a position displaced from the chamber, providing a source of radiation in the chamber, the source having properties of producing photons in the chamber, providing a conveyor path for a movement of the articles from the loading area through the chamber to the unloading area and for the irradiation of the articles by the source during the movement of the articles through the chamber, and providing a member in the chamber for inhibiting the movement of the photons to the walls defining the chamber, thereby minimizing the thickness of the walls wherein the member is an intermediate wall disposed in the chamber and separated by air gas from the walls defining the chamber and wherein a first path extends from the loading area to the chamber and wherein a second path extends from the unloading area to the chamber in adjacent relationship to the first path and wherein an additional wall is disposed outside of the chamber in a cooperative relationship with a particular one of the walls defining the chamber to define a confining relationship for the first and second paths and wherein the walls defining the chamber and the member and the additional wall are made from a radiation shielding material and wherein, the particular one of the walls defining the chamber is provided with a limited length to provide for a communication of the first and second paths with the chamber and wherein the beam stop is recessed in the one of the walls defining the chamber.

7. A method of providing an irradiation of articles including the steps of:

providing a chamber defined by a plurality of walls, providing a conveyor path for a movement of the articles through the chamber and for an irradiation of the articles by a radiation source during the movement of the articles through the chamber, providing a loading area for the articles at a position displaced from the chamber, providing an unloading area for the articles at a position displaced from the chamber, the conveyor path including the loading area and the unloading area, providing the source of radiation in the chamber, the source having properties of deriving ozone in the chamber, providing a member in the chamber for restricting the flow of the ozone in the chamber wherein the member is an intermediate wall disposed in the chamber in a spaced relationship to the walls defining the chamber and wherein the radiation source extends in the chamber through the intermediate wall and wherein the intermediate wall and the walls defining the chamber are made from a radiation shielding material and wherein one of the walls defining the chamber is on the opposite side of the chamber from the radiation source and wherein a beam stop is disposed in the one of the walls defining the chamber and wherein a first path extends from the loading area to the chamber and wherein a second path extends from the unloading area to the chamber in adjacent relationship to the first path and wherein an additional wall is disposed outside of the chamber in cooperative relationship with a particular one of the walls defining the chamber to define a confining relationship with the first and second paths and wherein the beam stop is recessed in the one of the walls defining the chamber.

8. A method as set forth in claim 7 wherein the particular one of the walls provide the chamber is provided with a length to define for a communication of the first and second paths with the loop in the chamber.

9. A method of providing an irradiation of articles, including the steps of:

providing a chamber defined by a plurality of walls, providing a conveyor path for the movement of the articles through the chamber and for the irradiation of the articles by a radiation source in the chamber during the movement of the articles through the chamber, providing a loading area for the articles at a position displaced form the chamber, providing an unloading area for the articles at a position displaced from the chamber, providing a first path from the loading area to the chamber, providing a second path from the chamber to the unloading area in adjacent relationship to the first path, the first and second paths being included in the conveyor path and being disposed in adjacent relationship to a particular one of the walls defining the chamber, disposing in the chamber an intermediate wall made from a radiation shielding material, providing an additional wall on an opposite side of the first and second paths from the particular wall wherein the walls defining the chamber and the additional wall are made from a radiation shielding material and the intermediate wall is separated from the walls defining the chamber and wherein, the first and second paths are substantially parallel and are contiguous and wherein the particular wall and the additional wall are substantially parallel to each other and to the first and second paths and are respectively contiguous to the first and second paths on opposite sides of the first and second paths and wherein one of the walls defining the chamber is on the opposite side of the chamber from the radiation source and wherein the radiation source extends through the intermediate wall and wherein a beam stop is recessed in the one of the walls defining the chamber.

* * * * *

UNITED STATES PATENT AND TRADEMARK OFFICE

CERTIFICATE OF CORRECTION

PATENT NO. : 6,127,687
DATED : October 3, 2000
INVENTOR(S) : Colin Brian Williams, et al.

It is certified that error appears in the above-identified patent and that said Letters Patent is hereby corrected as shown below:

Title page,
After "[76] inventors:" and before "[*] Notice:", add the following: -- Assignee: Titan Corporation, San Diego, CA (US) --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*